US012035772B2

(12) United States Patent
Fiero et al.

(10) Patent No.: US 12,035,772 B2
(45) Date of Patent: Jul. 16, 2024

(54) ACCESSORIES BELT ASSEMBLY WITH INNER AND OUTER SECTIONS

(71) Applicants: Travis Allen Fiero, Dalzell, SC (US); Alexander Robert Blais, Rehoboth, MA (US)

(72) Inventors: Travis Allen Fiero, Dalzell, SC (US); Alexander Robert Blais, Rehoboth, MA (US)

( * ) Notice: Subject to any disclaimer, the term of this patent is extended or adjusted under 35 U.S.C. 154(b) by 257 days.

(21) Appl. No.: 17/551,227

(22) Filed: Dec. 15, 2021

(65) Prior Publication Data

US 2022/0183414 A1 Jun. 16, 2022

Related U.S. Application Data

(60) Provisional application No. 63/125,829, filed on Dec. 15, 2020.

(51) Int. Cl.
*A41F 9/02* (2006.01)

(52) U.S. Cl.
CPC ..... *A41F 9/02* (2013.01)

(58) Field of Classification Search
CPC .. A41F 9/02; A41F 9/002; A41F 9/025; F41C 33/046; B25H 3/00; A41D 2200/10; A41D 2400/42; A41D 2400/424; A45F 2003/144
See application file for complete search history.

(56) References Cited

U.S. PATENT DOCUMENTS 1,279,753 A * 9/1918 Paymer ..... A41F 9/002 24/302
2,383,748 A * 8/1945 Sherman ..... A41F 9/002 224/663
3,069,691 A * 12/1962 Svojse ..... A41F 9/00 2/337
3,987,496 A 10/1976 Bernard
4,165,826 A 8/1979 Chica
4,993,551 A * 2/1991 Lindsay ..... B25H 3/00 383/7
5,464,136 A 11/1995 Eddy
(Continued)

OTHER PUBLICATIONS

Definition of "tactical", Cambridge online dictionary, Accessed Dec. 14, 2023 from https://dictionary.cambridge.org/us/dictionary/english/tactical (Year: 2023).*

*Primary Examiner* — Patrick J. Lynch
*Assistant Examiner* — Brianna T. Duckworth
(74) *Attorney, Agent, or Firm* — Douglas Denninger

(57) ABSTRACT

A belt assembly, and methods of using same, including an elongated inner portion having a first length and adapted to be worn inside a waistband of a garment of a wearer, and an elongated outer portion having a second length that is at least as long as the first length. The outer portion is adapted to occupy (i) an open, unfolded position when the inner portion is lowered inside the waistband, and (ii) a closed, folded position resting against the outside of the waistband. The inner portion is joined to the outer portion by connective material that bends when the outer portion is moved between the open and closed positions. The outer portion further includes a plurality of tactical openings along at least some of its length to which accessories can be removably attached.

18 Claims, 7 Drawing Sheets

(56) References Cited

U.S. PATENT DOCUMENTS

| | | | | |
|---|---|---|---|---|
| 5,639,003 | A * | 6/1997 | Utzinger, III | A45F 3/00 224/904 |
| 5,867,836 | A | 2/1999 | Quinones | |
| 6,138,282 | A | 10/2000 | Follese | |
| 6,446,269 | B1 | 9/2002 | Bessler et al. | |
| 8,225,976 | B2 | 7/2012 | Meunier | |
| 9,402,458 | B2 | 8/2016 | Kooyers | |
| 9,500,440 | B2 | 11/2016 | Gordon et al. | |
| 10,545,008 | B2 | 1/2020 | Noble | |
| 2004/0000571 | A1 | 1/2004 | Reiserer et al. | |
| 2009/0235431 | A1 | 9/2009 | Bevley | |
| 2014/0130236 | A1* | 5/2014 | Mack | A41D 13/1254 2/236 |
| 2014/0158733 | A1 | 6/2014 | McDonnell | |

* cited by examiner

ACCESSORIES BELT ASSEMBLY WITH INNER AND OUTER SECTIONS

CROSS-REFERENCE TO RELATED APPLICATION

This application claims priority to U.S. provisional patent application No. 63/125,829 filed 15 Dec. 2020. The entire contents of the above-mentioned application are incorporated herein by reference.

FIELD OF THE INVENTION

This invention relates to support belts which carry accessories such as tools and hand-guns on a wearer and more particularly to such belts which can be worn with any type of garment having a waistband.

BACKGROUND OF THE INVENTION

A common difficulty for people when walking or otherwise moving among different locations with one or more selected accessories such as hand tools, power tools, and/or hand-guns is to have their hands free to open doors, handle materials, assist other people, or simply rest between projects or events, yet still have the selected accessories readily accessible as needed.

Different types of equipment have been designed to facilitate carrying different kinds of accessories. A support belt that carries a gun holster and supports the lower back of a shooter is described by Eddy in U.S. Pat. No. 5,464,136. A concealed carry gun belt with a J-hook pocket is disclosed by Noble in U.S. Pat. No. 10,545,008. A clip-on utility carrier is shown by Reiserer et al. in U.S. Patent Application Pub. No. 2004/0000571.

It is therefore desirable to carry accessories in comfort, especially for extended periods of time, while maintaining easy access and freeing the hands of a wearer.

SUMMARY OF THE INVENTION

An object of the present invention is to provide a belt assembly suitable for carrying a number of easily-accessible accessories for extended periods without discomfort.

Another object of the present invention is to provide such a belt assembly which can be worn over any type of waistband.

This invention features a belt assembly to carry one or more accessories, the belt assembly including an elongated inner portion having a first length and adapted to be worn inside a waistband of pants or other garment of a wearer worn over the waist of the wearer, the waistband of the garment having an inside surface and an outside surface. The belt assembly further includes an elongated outer portion having a second length that is at least as long as the first length of the inner portion. The outer portion is adapted to occupy (i) an open, unfolded position to lie in substantially the same plane as the inner portion when the inner portion is lowered inside the waistband to rest against the inside surface of the waistband, and (ii) a closed, folded position resting against the outside surface of the waistband. The inner portion is joined to the outer portion by connective material that provides no noticeable resistance to bending when the outer portion is moved between the open and closed positions. The outer portion further includes a plurality of tactical openings along at least some of its length, preferably along a majority of its length, to which accessories can be removably attached directly and/or indirectly utilizing attachment hardware.

In one embodiment, the connective material is an extension of the inner portion that is secured to the outer portion; in other words, the connective material is monolithic with the inner portion in that embodiment. In other embodiments, the connective material is a separate component that is secured to both the inner portion and the outer portion. In certain integral-belt-type embodiments, the second length of the outer portion extends beyond the first length of the inner portion and includes fastener mechanisms at opposing ends such as snap fasteners, mating clasps such as plastic buckles, ribbon-type fasteners having rings such as double D-rings plus an opposing end (also referred to as a "free end" or a "working end") that is securable to the D-rings, and/or matching hook-and-loop fasteners. In other embodiments, a separate conventional belt is slidable through one or more loops in the outer portion. In one embodiment, which may be considered as a kit, the belt assembly further includes at least one support clamp having a first leg, a second leg, and a biasing element connecting the first leg and the second leg to each other.

This invention also features a method of releasably securing accessories about the waist of a user, including selecting a garment having a waistband, the waistband having an inside surface and an outside surface, and selecting a belt assembly including (A) an elongated inner portion having a first length and adapted to be worn inside the waistband of the garment and (B) an elongated outer portion having a second length that is at least as long as the first length. The method further includes lowering the inner portion between the waistband and the user to rest against the inside surface of the waistband while placing the outer portion into an open, unfolded position to lie in substantially the same plane as the inner portion when the inner portion is lowered inside the waistband, and then moving the outer portion into a closed, folded position to rest against the outside surface of the waistband. The inner portion is joined to the outer portion by connective material that provides no noticeable resistance to bending when the outer portion is moved between the open and closed positions. The outer portion further includes a plurality of tactical openings along its length to which accessories can be removably attached directly and/or indirectly utilizing attachment hardware. The belt assembly is then fastened, about the waist of the user, either directly utilizing a clasp arrangement that is integral with the belt assembly, or utilizing a conventional belt. In certain embodiments, one or more support clamps augment closure over the waistband.

BRIEF DESCRIPTION OF THE DRAWINGS

In what follows, preferred embodiments of the invention are explained in more detail with reference to the drawings, in which.

DETAILED DESCRIPTION OF THE PRESENTLY PREFERRED EMBODIMENTS

Figure 1:
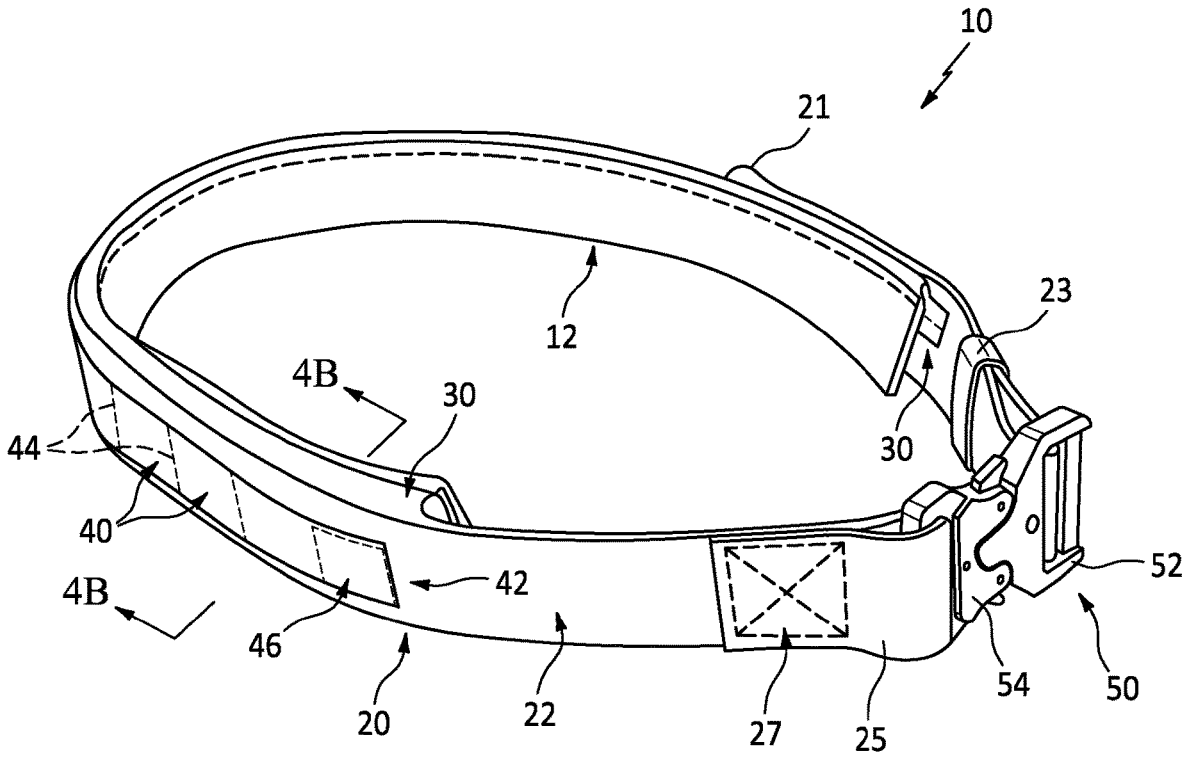
FIG. 1 is a schematic perspective view of a belt assembly according to the present invention in a closed (folded) position.

This invention may be accomplished by a belt assembly (also referred to herein as "B.E.L.T.") including an elongated inner portion having a first length and adapted to be worn inside a waistband of pants or other torso garment of a wearer, and an elongated outer portion having a second length that is at least as long as the first length. The outer portion is adapted to occupy (i) an open position, also referred to herein as an unfolded position, to lie in substantially the same plane as the inner portion when the inner portion is lowered inside the waistband to rest against the inside surface of the waistband, and (ii) a closed position, also referred to herein as a folded position, resting against the outside surface of the waistband. The inner portion is joined to the outer portion by connective material that provides no noticeable resistance to bending when the outer portion is moved between the open and closed positions. The outer portion further includes a plurality of tactical openings along its length to which accessories can be removably attached directly and/or indirectly utilizing attachment hardware.

The term "garment" as utilized herein refers to apparel having a waistband and includes pants, jeans, slacks, sweatpants and shorts that are worn by a wearer, also referred to as a user, at least partially over the torso of the wearer, particularly at or above the hips of the wearer and below the ribcage.

The term "attachment hardware" includes J-clips, spring-biased clips, hooks, hangers, and other metal or polymeric items that are fixedly or removably attachable to an accessory at one side or section of the attachment hardware and are removably securable at another side or section of the attachment hardware to at least one tactical opening according to the present invention.

The term "accessory" includes hand-tools such as hammers, saws, prybars, tools with handles (including those with finger-grips such as scissors and hand-grips such as screwdrivers, wire brushes and paintbrushes), crowbars and prybars, knives of all types, power tools, portable communication devices (such as walkie-talkies, pagers and smart phones), hand-guns and flashlights, as well as pouches, holsters, and other carrier mechanisms for carrying other accessories. Accessories may or may not have integral attachment hardware.

The term "substantially" as utilized herein encompasses deviations of up to ten percent, such as the inner portion and the outer portion being "in substantially the same plane" encompassing deviations up to ten degrees from each other in the open, unfolded position.

The terms "including" and "such as" as utilized herein are intended to be open-ended for listed examples and are not limitations of the invention.

Belt assemblies according to the present invention are intended to provide both comfort and function to a user for an array of common items, including but not limited to: gun holsters, hand tools, power tools, and accessory clips. These items will be inserted into the tactical openings provided throughout the belt. In one construction, the openings will be created by sewing two layers of nylon together vertically with a horizontal spacing of every 1.0 inch to 1.5 inch along the outer portion, leaving space for attachments of a wide variety. Belt assemblies are relatively compact and readily detachable from the wearer utilizing different adjustable clasps and other mechanisms as described below.

Figure 2A:
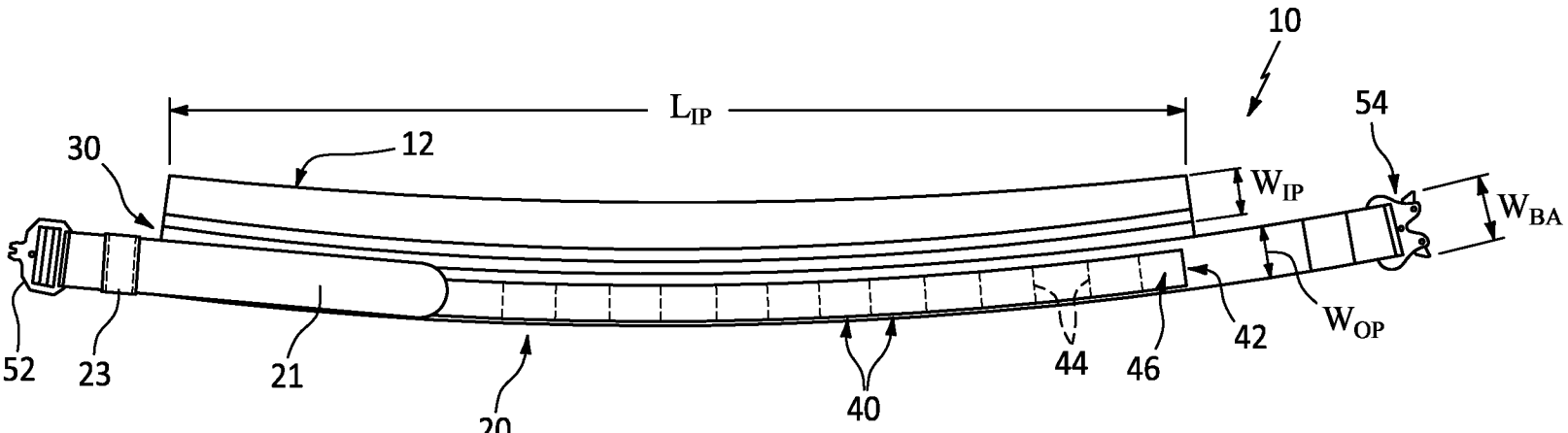
FIG. 2A is a schematic top view of the belt assembly of FIG. 1 in an open (unfolded) position.
Figure 2B:
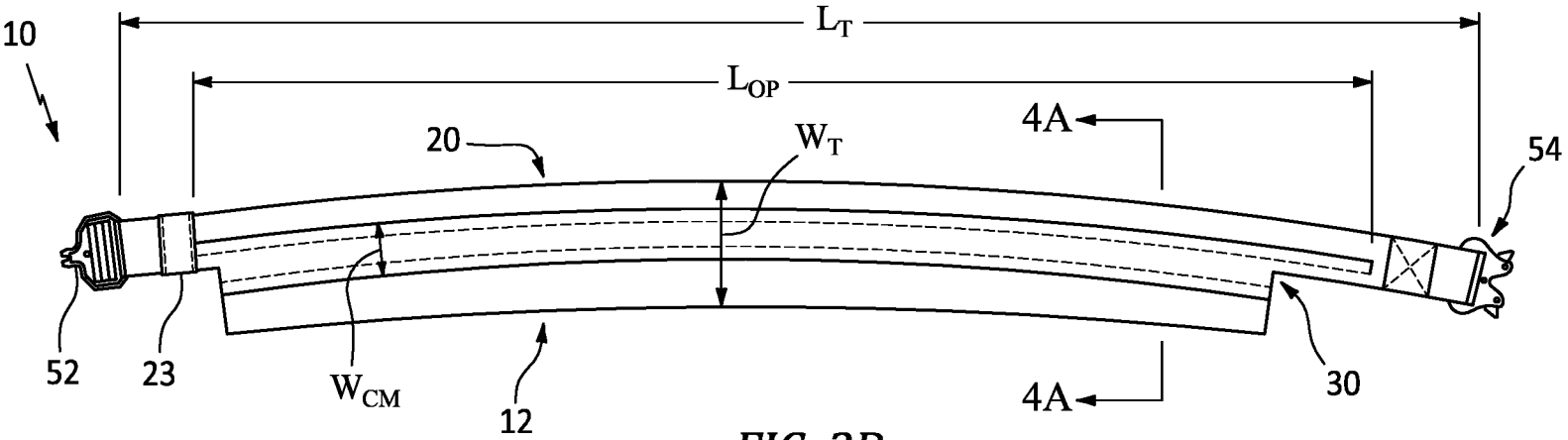
FIG. 2B is a view similar to FIG. 2A of the opposite side of the belt assembly.
Figure 3:
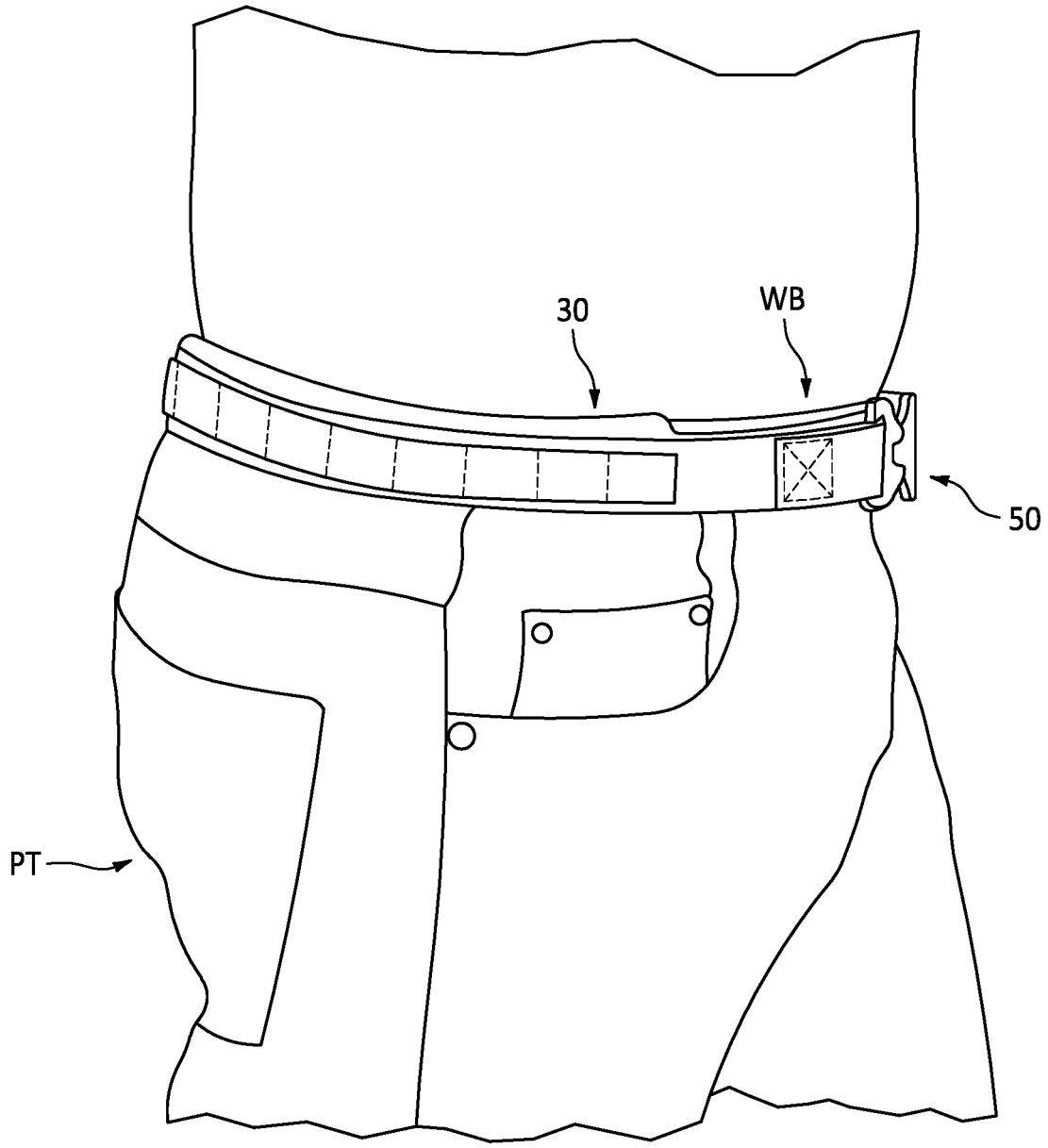
FIG. 3 is a schematic side view of the belt assembly of FIG. 1 installed on a waistband of a wearer in the closed position.

Belt assembly 10, FIGS. 1-3, has an elongated inner portion 12 having a first length $L_{IP}$ and is adapted to be worn inside a waistband WB of pants PT, FIG. 3. Pants PT represents any garment having a waistband. The belt assembly 10 further includes an elongated outer portion 20 having a second length $L_{OP}$ that is at least as long as the first length $L_{IP}$ of the inner portion 12. In this integral-belt-type construction, the second length $L_{OP}$ of the outer portion 20 extends beyond the first length $L_{IP}$ of the inner portion 12 such that the outer portion 20 has sufficient overall length to extend around the waist of a wearer who selects the belt assembly 10 with a desired overall length, either fixed or adjustable, as described in more detail below.

Figure 4A:
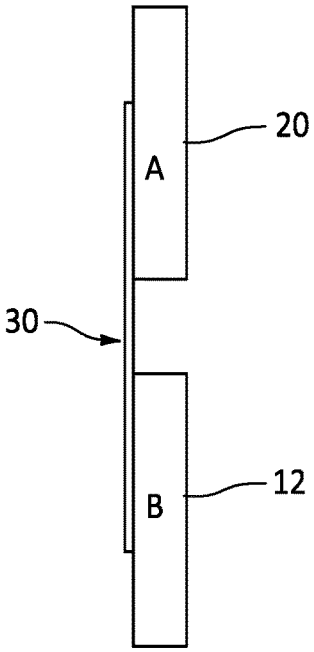
FIGS. 4A and 4B are schematic side cross-sectional views along lines 4A-4A of FIG. 2B and lines 4B-4B of FIG. 1, respectively, to represent open (unfolded) and closed (folded) positions of the belt assembly.
Figure 4B:
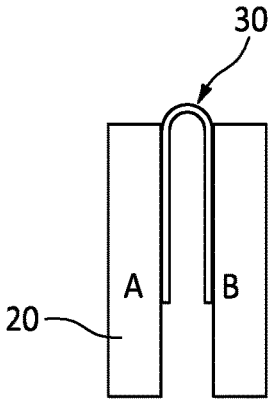
Figure 5A:
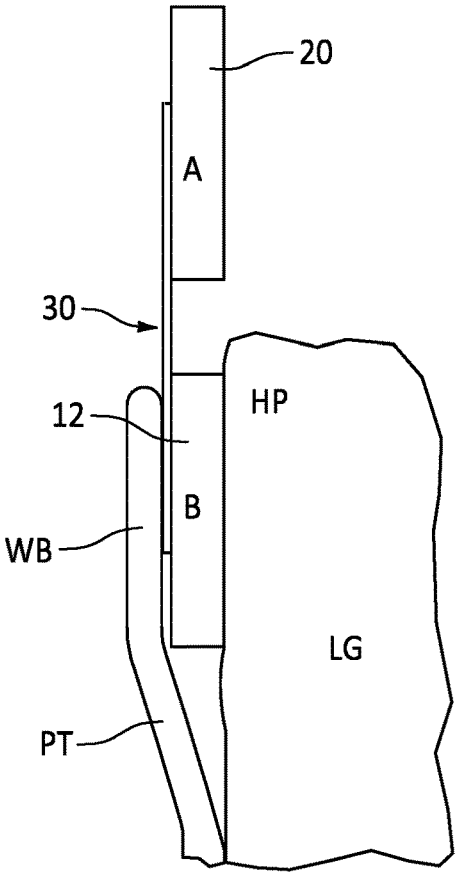
FIG. 5A is a view similar to FIG. 4A showing pants and portions of the wearer with the inner portion of the belt assembly inserted inside the waistband of the pants.

The outer portion 20 is adapted to occupy an open, unfolded position, FIGS. 2A-2B, 4A and 5A, and to lie in substantially the same plane as the inner portion 12 when the inner portion 12 is lowered inside the waistband WB, FIGS. 3 and 5A, to rest against the inside surface of the waistband WB. The user then folds or closes the outer portion 20 outward and downward into a closed, folded position resting against the outside surface of the waistband WB, FIGS. 3, 4B and 5B. In this construction, the total length $L_T$ can be adjusted before or after the user places the belt assembly 10 about the waist as described in more detail below.

The inner portion 12 is joined to the outer portion 20 by connective material 30, best shown in FIG. 2B, that provides no noticeable resistance to bending when the outer portion 20 is moved between the open and closed positions. The outer portion 20 further includes a plurality of tactical openings 40, also referred to herein as accessory openings 40 or simply as openings 40, along at least some of its length to which accessories can be removably attached directly and/or indirectly utilizing attachment hardware.

Openings 40 are formed in this construction by vertical stitching 44, shown in phantom, over woven nylon tactical material 42, also referred to herein as accessory strip 42. At least one end segment 46 of tactical material 42 is sewn with additional stitching and/or fastened with rivets, epoxy, and/or other type of fastener. In some constructions, openings 40 are open at both their top and bottom edges and, in other constructions, one or more of the openings 40 are closed at their bottom edge to form a pocket. In some constructions, an excess length of tactical material 42 is provided such that each opening 40 forms a bulge relative to the outer surface 22 of outer portion 20.

In the construction illustrated in FIGS. 1-3, the outer portion 20 includes an extended total length $L_T$ of 32"-44", typically 34"-40" after adjustment by a wearer, measured up to, but not including for measurement purposes, a clasp mechanism 50, also referred to as buckle mechanism 50, with a male section 52 and a female section 54. The outer portion 20 has a minimum length $L_{OP}$ which matches an outer edge of compliant material 30 which is sewn or otherwise secured to outer portion 20 as shown in FIG. 2B. In this construction, the outer portion 20 has an additional length with passes through a slot in the male section 52 to form a tail 21, FIG. 2A after passing through a retainer loop 23. The opposite end 25 of outer portion 20 passes through a slot in female section 54 and is secured to itself by stitching 27 in this construction.

Compliant material 30 has a width $W_{CM}$ of approximately two inches and has an inner edge which is sewn or otherwise secured to inner portion 12 along length $L_{IP}$ of approximately 26"-30" in this construction. Belt assembly 10 has a total width $W_T$ of approximately 3"-4" in the open, unfolded position illustrated in FIG. 2B. Outer portion 20 and inner portion 12 both have a width $W_{OP}$ and $W_{IP}$, respectively, of approximately 1.5 inch while clasp or buckle mechanism 50 has a width $W_{BK}$ of approximately 2 inches in this construction.

Figure 5B:
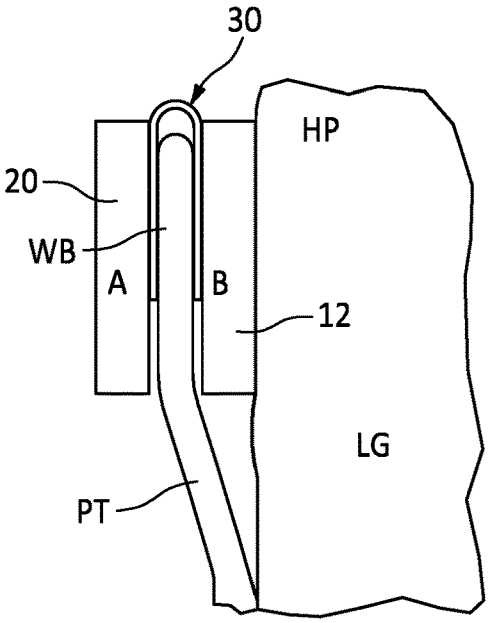
FIG. 5B is a view similar to FIG. 4B showing pants and portions of the wearer with the belt assembly closed around the top of the waistband of the pants.

FIGS. 4A and 4B are schematic side cross-sectional views along lines 4A-4A of FIG. 2B and lines 4B-4B of FIG. 1, respectively, to represent open (unfolded) and closed (folded) positions of the belt assembly. FIG. 5A is a view similar to FIG. 4A showing pants PT, leg LG and hip HP of the wearer with the inner portion 12 of the belt assembly inserted inside the waistband WB of the pants PT. FIG. 5B is a view similar to FIG. 4B showing the belt assembly 10 closed around the top of the waistband WB of the pants PT.

Materials suitable for inner and outer portions of belt assemblies according to the present invention including woven nylon (polyamide) webbing, denim or other weave of cotton material, leather, and other woven natural or synthetic fabrics. In some constructions, the material of inner portion 12 is less stiff and/or a finer weave than the material utilized for outer portion 20. Connective material 30 can include nylon, cotton, Lycra/Spandex stretch material, elastic waistband material, felt, polyester, and other woven or non-woven natural or synthetic fabrics.

A narrower and/or thinner nylon material, denim, or other woven fabric can serve as accessory strip 42, also referred to as tactical material 42. Thread utilized for stitching 44, also referred to herein as sewing interval 44, can include nylon, cotton, polyester or wool.

Figure 6:
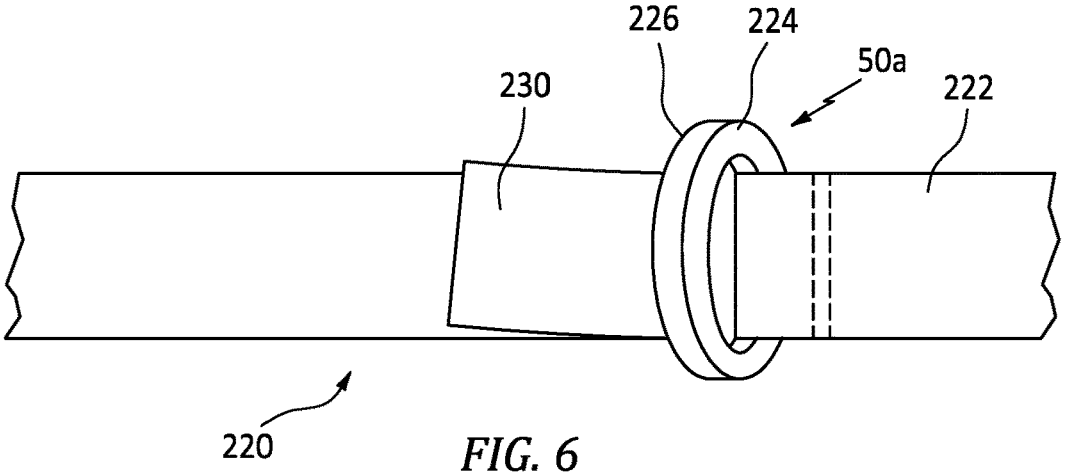
FIG. 6 is a schematic front view of an alternative ribbon belt with a working end slid around two rings such as D-rings.
Figure 7:
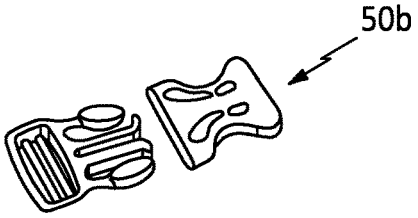
FIG. 7 is a schematic view of polymeric buckle components.
Figure 8A:
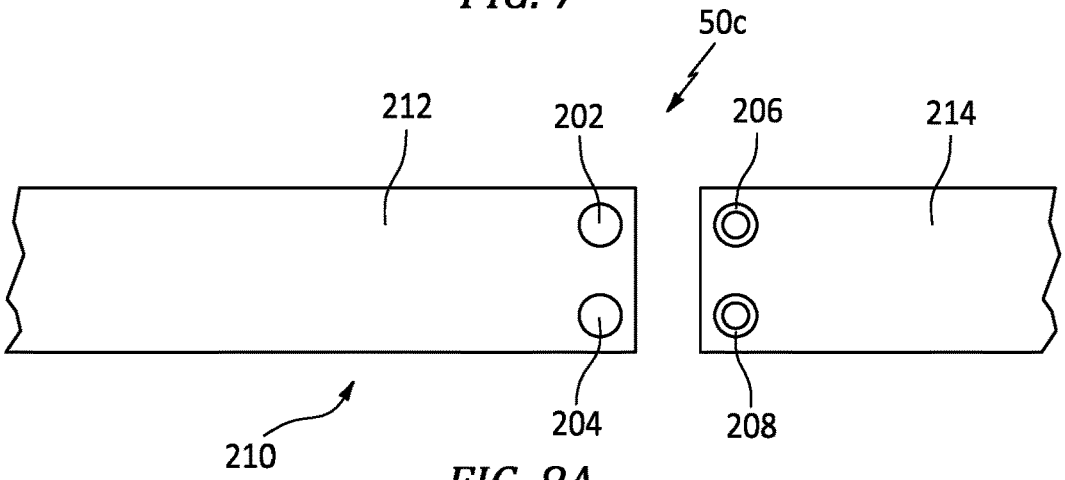
FIGS. 8A and 8B are schematic front views of metal snaps in unlocked and locked positions, respectively.
Figure 8B:
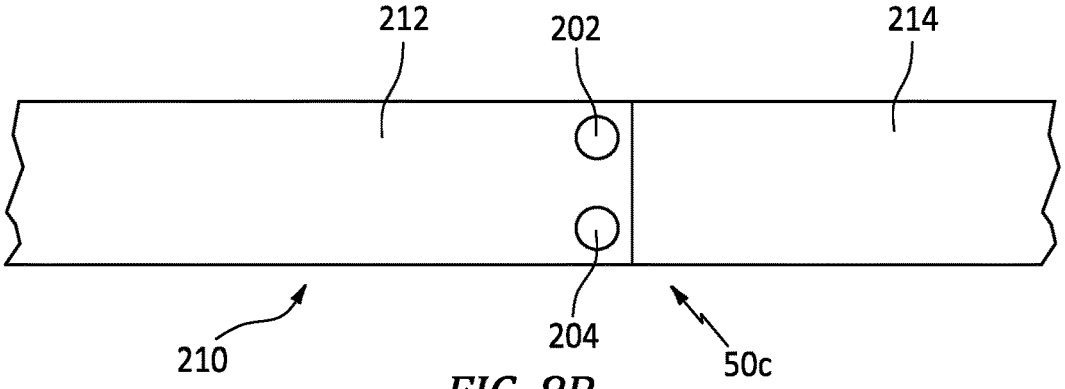

Various alternative clasps and closures can be utilized for belt assemblies according to the present invention to maintain tension of the belt assembly around the waist of a wearer to hold a garment by hugging the wearer's waist. An alternative adjustable-fit ribbon belt 220, FIG. 6, has a working end 230, also referred to as a free end 230, slid around and between two metal rings 224, 226, such as D-rings held by an opposing fixed end 222, to serve as a clasp 50*a*. FIG. 7 is a schematic view of polymeric buckle components 50*b*. FIGS. 8A and 8B are schematic front views of metal snaps 202 and 206 plus 204 and 208 in unlocked and locked positions, respectively of a fixed-length belt 210 having a first end 212 and a second end 214. The underside of snaps 202, 204 have projections which snap-fit into snap receptacles 206, 208, respectively, in one construction. In other constructions, other conventional closures such as draw-strings are utilized, such as lengths of parachute cord.

Figure 9:
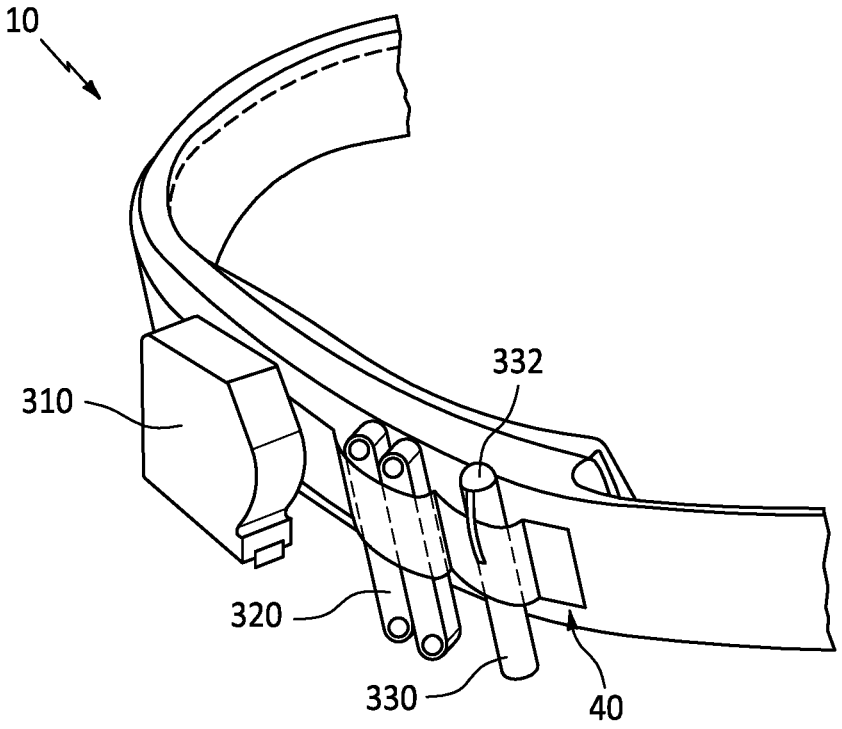
FIG. 9 is a schematic perspective view of a portion of the belt assembly of FIG. 1 with three accessories held by integral clips on the accessories.
Figure 10:
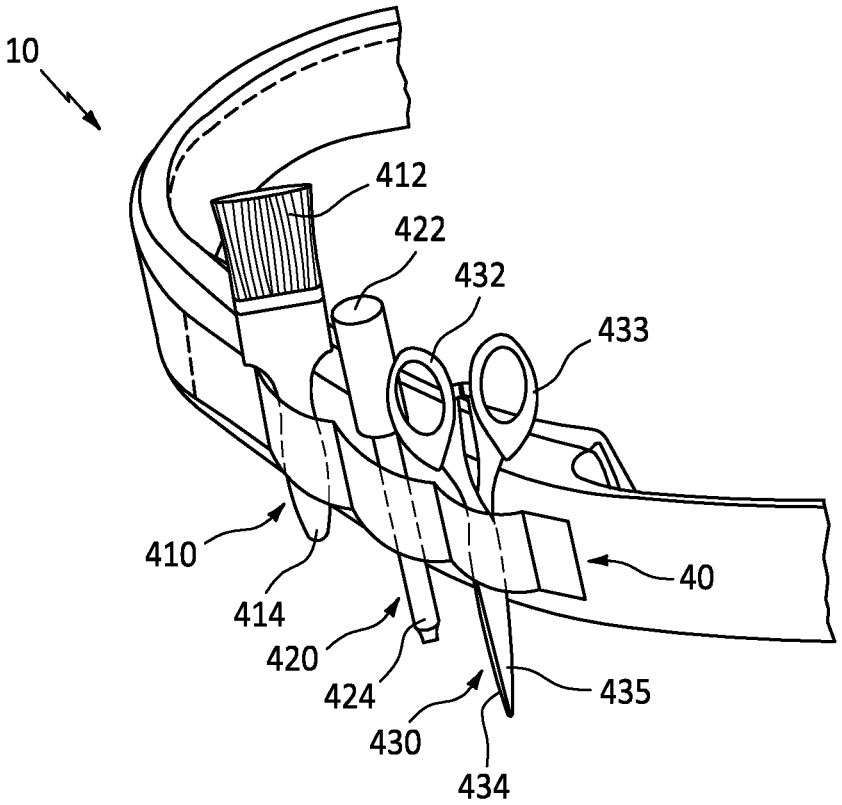
FIG. 10 is a schematic perspective view of a portion of the belt assembly of FIG. 1 with three accessories placed directly into the belt assembly.

FIG. 9 illustrates the belt assembly 10 of FIG. 1 with three accessories held to openings 40 by integral clips (not visible) on each of the accessories, such as a tape measure 310, a LEATHERMAN® Wingman® tool 320 and a SHARPIE® King or Magnum marker 330 having a clip integral with cap 332. By comparison, FIG. 10 shows belt assembly 10 carrying three accessories with handles or shafts placed directly into openings 40 of the belt assembly such as a paint brush 410 having a brush 412 on a narrow handle 414, a slotted or flat screw driver 420 having a hand-grip 422 and a shaft 424, and scissors 430 having finger-grips 432, 433 and blades 434, 435. Accessories 410, 420 and 430 all have sufficiently narrow diameters or other cross-sectional dimensions to enable placement through one of the tactical openings 40. In yet other constructions, separate "carriers" such as pouches, hooks or holsters are removably attached to openings 40, and the carriers then can be filled with other objects (pocket knives, circuit testers, stud-finders, etc.) to be transported while being readily available to the user of the belt assembly 10.

Figure 11:
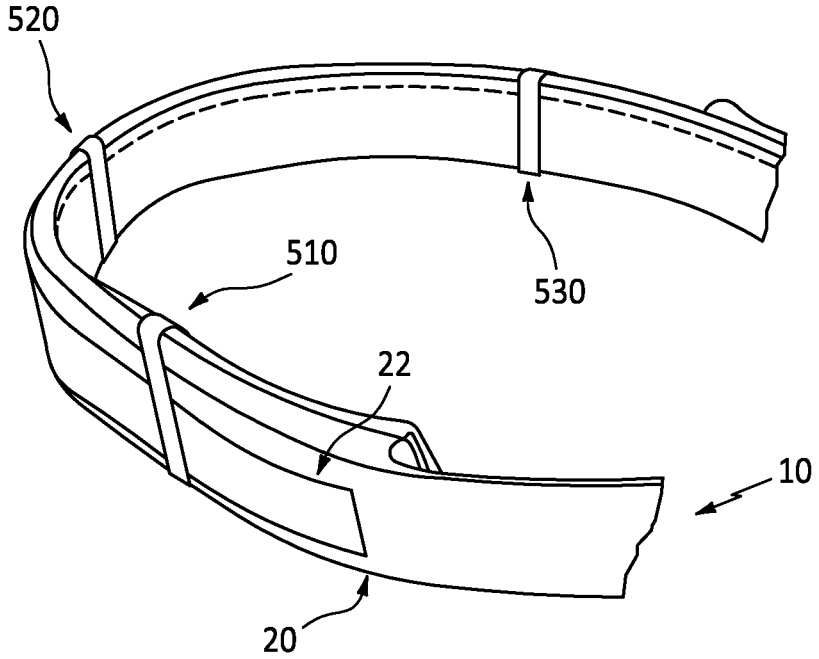
FIG. 11 is a schematic perspective view of the belt assembly of FIG. 1 augmented with three support clamps.
Figure 12A:
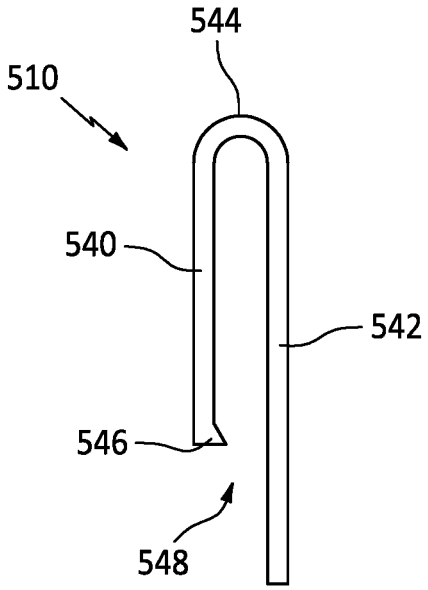
FIG. 12A is a schematic side view of one of the support clamps of FIG. 11.
Figure 12B:
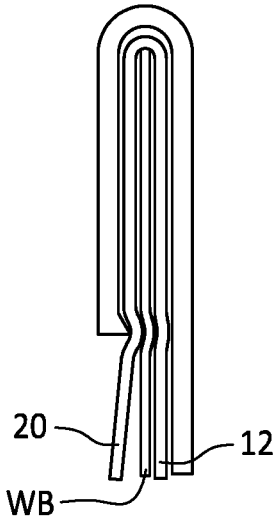
FIG. 12B is a schematic cross-sectional view of the support clamp of FIG. 12A engaged over the belt assembly shown in FIG. 5B closed over the waistband.

FIG. 11 shows belt assembly 10 augmented with three optional support clamps 510, 520 and 530, also referred to herein as support points or support clips. Support clamp 510 is shown by itself in FIG. 12A and, in FIG. 12B, engaged over the belt assembly shown in FIG. 5B closed over the waistband WB to augment the closed position of the outer portion 20 against the waistband WB. Each support clamp has a first leg 540, a second leg 542, and a biasing element 544 connecting the first leg 540 and the second leg 542 to each other to resist separation. In this construction, end 546 of leg 540 also has an inward-facing projection 540 to engage the outer surface 22 of the outer portion 20; in another construction, leg 540 has a length greater than the width of the outer portion 20 so that the projection 548 engages an outer surface of waistband WB or other region of the garment of the user. Materials suitable for support clamps 510, 520, 530 include resilient polymeric materials and metal alloys, especially when the support clamp is monolithic (that is, all components are manufactured to be integral with each other). Preferably, at least the inner-facing surfaces of each support clamp (but not including any projections 548) are smooth to provide low-friction surfaces to enhance placement by a user of one or more support clamps wherever desired over a belt assembly when in the closed position over a waistband, such as illustrated in FIG. 12B.

A kit according to the present invention includes a belt assembly plus (i) at least one piece of accessory hardware and/or (ii) at least one support clamp.

Holsters: Common gun holsters are equipped with some sort of attachment feature, usually a J-clip. These will fit easily and securely into any tactical openings.

Hand Tools: There are many attachments one can put onto a hammer, saw, crowbar, etc, that allows the wearer to secure the tools to their toolbelt. The tactical openings will be able to accommodate most of these designs with standard-size openings; in some constructions, custom-size openings can be provided for non-standard sizes.

Power Tools: Similar to hand tools, power tools can be fastened to belt assemblies according to the present invention in the same manner as for conventional tool belts.

Custom arrangements can be provided for battery packs to be attached to the belt easily as well.

Accessory Clips: Conventional accessory clips, both polymeric and metal, are manufactured in many areas at reasonable costs and suitable for use according to the present invention.

Tactical Openings: The pre-measured space between vertical increments created by sewing the two separate pieces of fabric together. The space will be designed to fit standard holsters, and tool clips. The constant spacing will also provide for flexibility/creativity of the wearer to attach different items. The number of openings depends on size of B.E.L.T. In some constructions, accessory clips such as J-clips are pre-inserted and sewn into the belt at desired increments. Power tool/battery slide inserts can also be sewn into the belt.

Detachability: In some constructions, the belt is designed to securely attach to 3-5 main support points around the wearer's waist. As described below, these support points will be removable, and adjustable. Allowing wearer to find their ideal comfort wear, as, well as adjust to, disproportionate weight distribution, and adjust when changing pant material if necessary, for comfort/function.

Support Points: In some constructions, one or more support points, such as support clamps shown in FIGS. 11-12B, are utilized to assist securing a belt assembly to pants of a wearer. Support points in one construction are durable, double J-Clips that fit into (2) Tactical openings, while pinching the underlying fabric within the B.E.L.T layers. These will have an additional button, or clip that will ensure each support point holds tight. The remaining tactical openings can be used at will from this point. —Secondary-strong metal buckles, located slightly left, and slightly right of the middle of the belt, to avoid irritation on spine/hips. —Option 1—There are 1-3 major support points (back only) (back, left hip, right hip). —Option 2—There are 2 support points only, (back left, back right) to hold the belt on. As well as the clip in front, that will secure the waistband to the B.E.L.T, as well as the belt to the wearer. —Option 3—No support points, rely on tension and cobra clip to hold B.E.L.T Although specific features of the present invention are shown in some drawings and not in others, this is for convenience only, as each feature may be combined with any or all of the other features in accordance with the invention. While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature.

It is the intention, therefore, to be limited only as indicated by the scope of the claims appended hereto. Other embodiments will occur to those skilled in the art after reviewing the present disclosure and are within the following claims.

What is claimed is:

1. A method of releasably securing accessories about a waist of a user, the waist including a back, a left side, a right side, and a front of the user, the method comprising:

selecting a garment having a waistband, the waistband having an inside surface and an outside surface;

selecting a belt assembly including (A) an elongated inner portion having a first length that is sufficient to extend along the left side, the back, and the right side of the user and adapted to be worn inside the waistband of the garment and (B) an elongated outer portion having a second length that is at least as long as the first length;

lowering the inner portion between the waistband and the user to rest against the inside surface of the waistband while placing the outer portion into an open, unfolded position when the inner portion is lowered inside the waistband;

moving the outer portion into a closed, folded position to rest against the outside surface of the waistband;

wherein the inner portion is joined to the outer portion by connective material that bends when the outer portion is moved between the open and closed positions; and the outer portion further including a plurality of tactical openings along at least some of its length to which accessories can be removably attached directly and/or indirectly utilizing attachment hardware.

2. The method of claim 1 further including securing the belt assembly around the waist of the user.

3. The method of claim 2 further including placing at least one support clamp over a selected area of the outer portion and the inner portion to augment the closed position of the outer portion against the waistband.

4. The method of claim 3 wherein the support clamp is monolithic.

5. The method of claim 2 wherein the outer portion includes fastener mechanisms at opposing ends to removably secure the belt assembly around the waist of the user.

6. The method of claim 1 wherein the connective material is an extension of the inner portion that is secured to the outer portion.

7. The method of claim 1 wherein the connective material is a separate component that is secured to both the inner portion and the outer portion.

8. The method of claim 1 wherein the connective material has a length at least as long as the first length of the inner portion.

9. The method of claim 1 wherein the connective material is thinner in cross-section than either of the inner portion or the outer portion.

10. The method of claim 1 further including removably attaching at least one accessory to the belt assembly.

11. The method of claim 10 wherein at least one tool is selected as the accessory that is removably attached to the belt assembly.

12. The method of claim 1 further including an accessory strip of material extending along the outer portion that defines at least some of the tactical openings.

13. The method of claim 12 wherein the accessory strip is thinner than outer portion.

14. The method of claim 1 wherein each tactical opening is defined as an opening between the outer portion and a woven material that is secured to the outer portion.

15. A method of releasably securing accessories about a waist of a user having a back, a left hip and a right hip, the method comprising:

selecting a garment having a waistband, the waistband having an inside surface and an outside surface;

selecting a belt assembly including (A) an elongated inner portion having a first length that is sufficient to extend along the left hip, the back, and the right hip of the user and adapted to be worn inside the waistband of the garment and (B) an elongated outer portion having a second length that is at least as long as the first length;

lowering the inner portion between the waistband and the user to rest against the inside surface of the waistband while placing the outer portion into an open position when the inner portion is lowered inside the waistband;

thereafter moving the outer portion over the waistband and into a closed position to rest against the outside surface of the waistband;

wherein the inner portion is joined to the outer portion by connective material that bends when the outer portion is moved between the open and closed positions; and the outer portion further including a plurality of tactical openings along at least some of its length to which accessories can be removably attached directly and/or indirectly utilizing attachment hardware.

16. The method of claim 15 further including securing the belt assembly around the waist of the user.

17. The method of claim 16 wherein the outer portion includes fastener mechanisms at opposing ends to removably secure the belt assembly around the waist of the user.

18. The method of claim 16 further including an accessory strip of material extending along the outer portion that defines at least some of the tactical openings.

* * * * *